United States Patent [19]

Howard et al.

[11] 3,992,748

[45] Nov. 23, 1976

[54] CARPETING TOOL FOR A VACUUM CLEANER

[75] Inventors: Sol Howard; Robert Schaaf, both of Brooklyn, N.Y.

[73] Assignee: Air Filters, Inc., Brooklyn, N.Y.

[22] Filed: May 7, 1975

[21] Appl. No.: 575,408

[52] U.S. Cl. ..... 15/397

[51] Int. Cl.[2] ..... A47L 9/06

[58] Field of Search ..... 15/369, 397, 402

[56] References Cited

UNITED STATES PATENTS

| | | | |
|---|---|---|---|
| 3,689,956 | 9/1972 | Melreit | 15/397 |
| 3,745,604 | 7/1973 | Fitzwater | 15/402 |
| 3,765,052 | 10/1973 | Anderson et al. | 15/397 X |
| 3,787,920 | 1/1974 | Evans et al. | 15/397 X |
| 3,878,582 | 4/1975 | Hukuba | 15/397 |

*Primary Examiner*—Christopher K. Moore
*Attorney, Agent, or Firm*—Friedman, Goodman & Teitelbaum

[57] ABSTRACT

A carpeting tool for a broom-type vacuum cleaner comprising a hollow rake. The hollow rake includes a plurality of spaced hollow open-ended teeth and a plurality of spaced air passage openings interposed respectively between certain of the teeth. The hollow rake further has a pair of oppositely extending lateral hollow flange portions and a nozzle integral with and intermediary of the flange portions. The flange portions have a lowermost lateral surface from which extend the hollow teeth, and in which are formed the air passage openings. A pair of spaced apart rollers are mounted between the teeth, and extend below the open ends of the teeth to support the combined weight of the tool and vacuum cleaner when the tool is attached to the vacuum cleaner for use thereof. The rollers permit the tool to ride smoothly along the carpeting without abruptly snagging the carpeting.

8 Claims, 5 Drawing Figures

CARPETING TOOL FOR A VACUUM CLEANER

BACKGROUND OF THE INVENTION

The present invention relates generally to a carpeting tool for a vacuum cleaner, and more particularly to a carpeting tool for a broom-type vacuum cleaner where the tool is provided with rollers to support the combined weight of the tool and vacuum cleaner during use, so that the tool rides smoothly along the carpeting without abruptly snagging the carpeting.

Carpeting tools for vacuum cleaners having teeth extending therefrom are well known in the art such being disclosed in the Applicants' own U.S. Pat. No. 3,800,359, granted on Apr. 2, 1974. However, when such a carpeting tool is attached to a broom-type vacuum cleaner, where the teeth must support the weight of both the tool and the vacuum cleaner, many problems arise. These problems include the teeth being snagged in the carpeting, particularly when the carpeting is of the shag variety. Additionally, the teeth of the tool do not ride smoothly along the carpeting, where there is a possibility of tooth fracture. Furthermore, it is difficult for the user to alternately move the teeth forwardly and rearwardly along the carpeting due to the weight of the broom-type vacuum cleaner which is carried by the teeth of the tool.

SUMMARY OF THE INVENTION

Accordingly, it is an object of the present invention to provide a carpeting tool for a vacuum cleaner which overcomes the disadvantages of the prior art.

Another object of the present invention is to provide a carpeting tool provided with teeth extending therefrom for cleaning the carpeting, that will not snag in the carpeting.

A further object of the present invention is to provide a carpeting tool provided with teeth extending therefrom that will ride smoothly along the carpeting, where there is no possibility of tooth fracture.

A still further object of the present invention is to provide a carpeting tool for a broom-type vacuum cleaner, where it is easy for the operator of the vacuum cleaner to alternately move the tool forwardly and rearwardly along the carpeting, overcoming the weight of the vacuum cleaner which is carried by the tool.

A still further object of the present invention is to provide a carpeting tool having teeth extending therefrom and rollers disposed thereon for accomplishing the above-mentioned objects.

To this end, the present invention relates to a carpeting tool for a vacuum cleaner, particularly a broom-type vacuum cleaner, comprising a hollow rake. The hollow rake includes a plurality of spaced hollow open-ended uniformly tapered teeth and a plurality of spaced air passage openings interposed respectively between certain of the teeth, each of the teeth terminating in an enlarged oval opening extending in a plane inclined relative to the longitudinal axis of each of the teeth. A pair of spaced apart rollers are mounted between the teeth, and extend below the open ends of the teeth to support the combined weight of the tool and vacuum cleaner when the tool is attached to the vacuum cleaner for use thereof.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DETAILED DESCRIPTION OF THE PREFERRED EMBODIMENT

Figure 1:
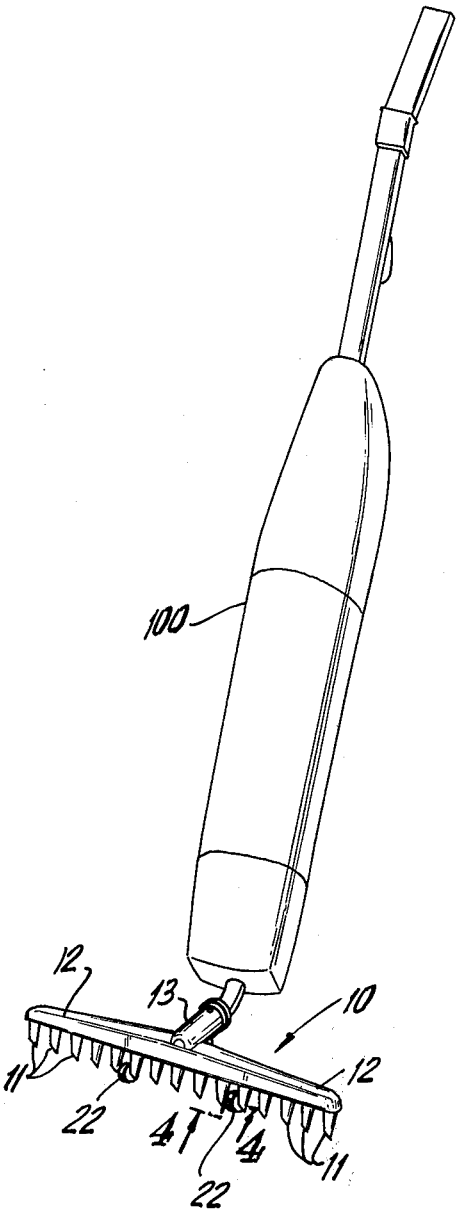
FIG. 1 represents a perspective view of the carpeting tool according to the present invention, which is attached to a broom-type vacuum cleaner.

Referring now to the drawings, and more specifically to FIG. 1 thereof, the present invention comprises a carpeting tool or hollow rake denoted by the reference character 10. The carpeting tool 10 is adapted to be attached to a vacuum cleaner, and more particularly to a broom-type vacuum cleaner 100, such vacuum cleaners being well known in the art where no further discussion thereof is thought necessary. As shown in the drawing, the carpeting tool 10 supports the weight of the vacuum cleaner 100 in conventional use thereof, where the user holds the vacuum cleaner 100 above the vacuum cleaner tool 10 when the tool is being alternately stroked forwardly and rearwardly along the carpeting. The carpeting tool 10 has many of the features of Applicants' patented carpeting tool disclosed in the above-mentioned U.S. Pat. No. 3,800,359, to which reference may be made.

The carpeting tool 10 is provided with a plurality of downwardly, generally uniformly, tapering open-ended hollow teeth 11 which are co-extensive and parallel to one another. The tool 10 further includes two oppositely extending lateral hollow flanges 12, and an open-ended nozzle connection 13 disposed intermediately between the flanges 12. The nozzle connection 13 is adapted to be connected to the vacuum cleaner 100 in a conventional manner, well known in the art.

Figure 2:
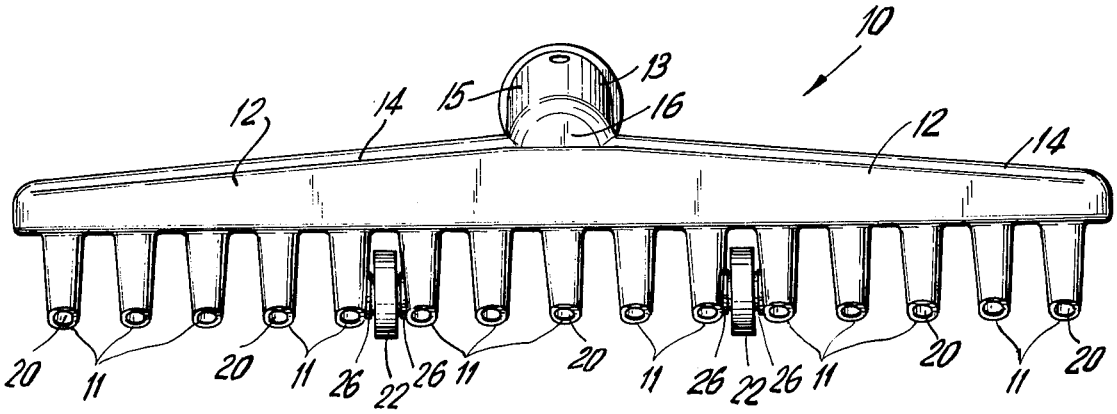
FIG. 2 illustrates a front elevational view of the carpeting tool shown in FIG. 1.

As best shown in FIG. 2, the lateral flanges 12 have an upper surface 14, and the nozzle connection 13 has a rounded surface 15 extending into the upper surface 14 of the flanges 12. Furthermore, the nozzle connection 13 has a flat inclined surface 16 terminating in a circular edge connected to the rounded surface 15 of the nozzle connection 13.

Figure 3:
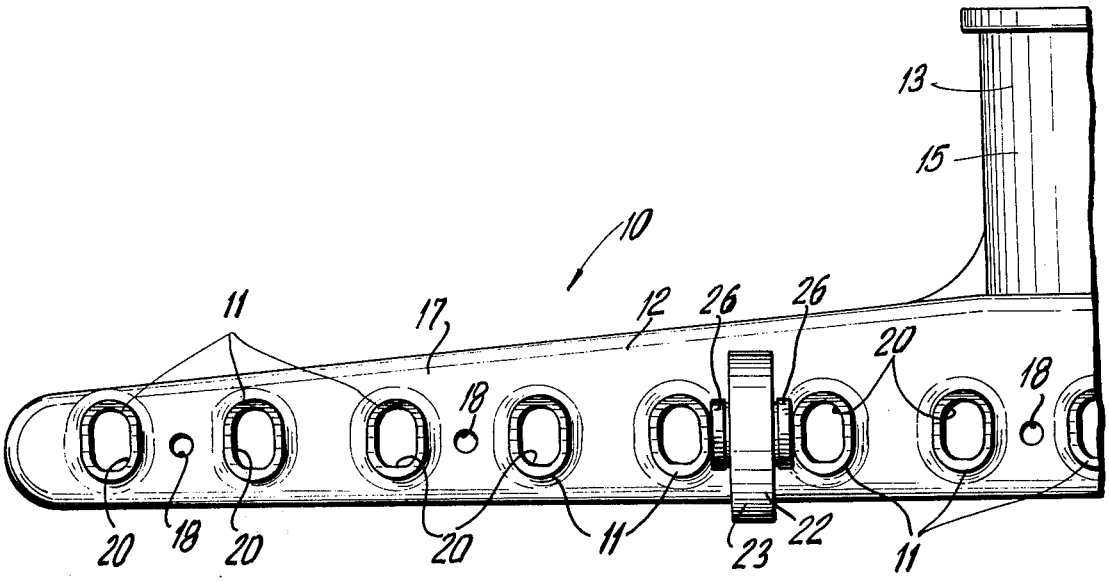
FIG. 3 illustrates an enlarged fragmentary bottom plan view, along a line parallel to the longitudinal axes of the teeth.

As shown in FIG. 3, the flanges 12 have a mutual lower surface 17 at the underside thereof, from which extends the hollow teeth 11 in uniformly laterally spaced relationship. The lower surface 17 is provided with a plurality of air passage openings 18, which are separated from one another preferably by two of the teeth 11 in each instance. The teeth 11 have open-ended portions defining openings 20 which are remote from the air passage openings 18 in the surface 17. As a result, the user of the carpeting tool 10, according to the present invention, need merely stroke the carpeting, such as carpeting of the shag variety, and the teeth 11 will groom the lowermost depth of the shag carpeting to remove the fine particles therefrom, and the air passage openings 18 which slide along the uppermost portions of the shag carpeting will simultaneously groom the upper surface of the carpeting to remove dust, dirt and particles from these upper portions.

The nature of the teeth 11 form an important aspect of the present invention in that each of the teeth 11 are both externally and internally tapered, and terminate in a free end portion in which is provided or formed the enlarged openings 20 of generally eliptical or oval configuration. The enlarged nature of the oval opening 20 stems from the fact that it lies in a plane which extends transversely and upwardly inclined relative to the longitudinal axis of each of the teeth 11, in a lateral direction forwardly of the teeth.

The inclination of the plane in which the oval openings 20 are formed serves to not only provide a greater open area through which particles or debris at the very depth of the shag carpeting can be passed through and into the teeth 11, which in each instance taper to a minimal so as to deeply gauge the depths of the shag carpeting, but also permits the rake or tool 10 to be alternately stroked forwardly and rearwardly of the teeth 11 in a manner which reduces the possibility of tooth fracture.

Figure 5:
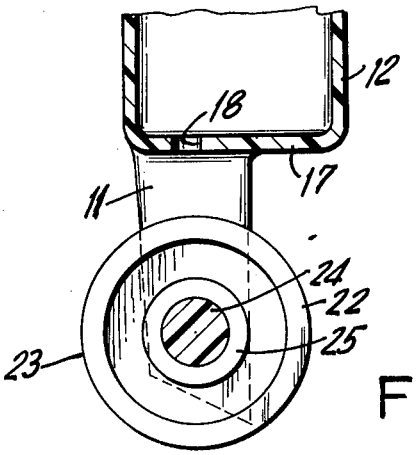
FIG. 5 illustrates a cross sectional view taken along the line 5—5 in FIG. 4.

In this respect, the tool 10 may be maintained such that, in a manner illustrated in FIG. 5, the teeth 11 are substantially vertically disposed whereby the nozzle 13 is extended upwardly and rearwardly with respect to the teeth 11. This permits the inclined open free end 20 of each of the teeth 11 to ride forwardly smoothly along the depth of the shag carpeting without substantially snagging the carpeting, which may otherwise cause tooth fracture. The inclined open free end 20 of each of the teeth 11 acts as a camming surface for riding smoothly along the shag carpeting.

Figure 4:
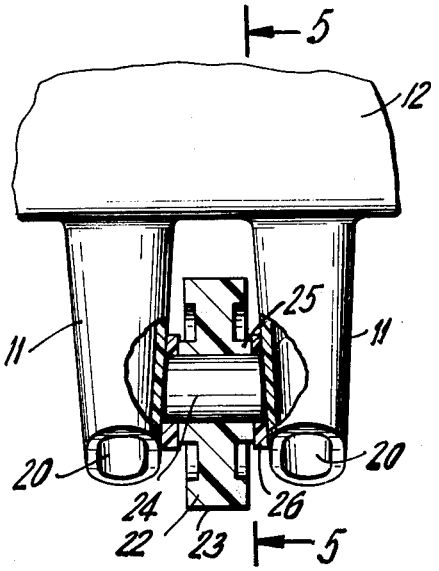
FIG. 4 illustrates a further enlarged fragmentary front elevational view, partly in section, of adjacent teeth supporting one of the rollers.

However, to overcome the weight of the broom-type vacuum cleaner 100, which would normally force the teeth 11 downwardly into the carpeting and impede the movement thereof along the carpeting, the carpeting tool has been improved to include rollers or wheels 22 to ride along the carpeting. The wheels 22 include a smooth circular peripheral surface 23 for rolling on the carpeting, and a centrally located hub portion 25 provided with an opening extending therethrough. A pin 24 extends through each hub opening and is secured by conventional means, such as an adhesive, cement or like material, to the outer sidewalls of two adjacent teeth 11, being disposed between the two adjacent teeth 11. Preferably, a pair of washers 26 are disposed, through openings therein, on each pin 24 on each side of the wheel 22 to register or align the wheel 22 in an upright position for rolling, as shown in FIGS. 4 and 5.

Preferably, the wheels 22 extend approximately one-eighth of an inch below the tips of the teeth 11. The pair of wheels 22 are preferably positioned on each side of the nozzle 13, being spaced apart by five teeth 11 in a fifteen teeth vacuum cleaner tool. However, it is understood, that the location of the wheels 20 can be altered depending upon the size and number of teeth in the vacuum cleaner tool 10, where additional wheels 22 can be added if required. It is further noted, that though the rolling motion of the wheel 22 is preferred, should the wheel 22 become jammed or entangled with the yarn from the carpeting as occasionally happens, the arcuate surface 23 of the wheel 22 would provide a sliding motion to permit the tool 10 to ride over the carpeting.

It is clear from the above, that the present invention provides a singular carpeting tool which simultaneously grooms both the uppermost and the lowermost surfaces of the shag carpeting quickly, efficiently and easily, thus filling a void in the art. Thus, the wheels 22 support the combined weight of the tool and broom-type vacuum cleaner and permit the tool to ride smoothly along the carpeting without abruptly snagging the carpeting, and further reduces the possibility of tooth fracture. Preferably, all the components of the vacuum cleaner tool 10 are fabricated from plastic or similar material.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A carpeting tool for a broom-type vacuum cleaner, said tool comprising two oppositely extending lateral hollow flanges, an open ended connecting tube secured intermediately between said flanges to upper surfaces of said flanges, said connecting tube extending rearwardly and upwardly from said flanges, said flanges including a mutual lower surface opposite each of said upper surfaces of said flanges, a plurality of spaced hollow teeth extending vertically downwardly from said lower surface on each side of said connecting tube to define a hollow rake, an opening provided in a free end portion of each of said teeth for communicating through each of said teeth into said flanges to said connecting tube, support means connected to said tool and extending below said free end portion of each of said teeth for supporting said tool and the vacuum cleaner when said tool is attached to the vacuum cleaner, said support means including an arcuate surface means for permitting said tool to be alternately stroked forwardly and rearwardly with said arcuate surface means in contact with carpeting in a manner which permits said tool to ride smoothly along the carpeting without abruptly snagging the carpeting, said arcuate means being disposed between adjacent teeth, said arcuate means being connected to said adjacent teeth, whereby weight of the vacuum cleaner is carried by said arcuate surface means rather than being carried by said teeth.

2. A carpeting tool as claimed in claim 1, wherein said arcuate means includes a pair of spaced apart wheels for rolling on the carpeting.

3. A carpeting tool as claimed in claim 1, wherein said arcuate means extend approximately one-eighth of an inch below said free end portion of each of said teeth of said tool.

4. A carpeting tool for a broom-type vacuum cleaner, said tool comprising two oppositely extending lateral hollow flanges, an open ended connecting tube secured intermediately between said flanges to upper surfaces of said flanges, said connecting tube extending rearwardly and upwardly from said flanges, said flanges including a mutual lower surface opposite each of said upper surfaces of said flanges, a plurality of spaced hollow teeth extending vertically downwardly from said lower surface on each side of said connecting tube to define a hollow rake, an opening provided in a free end portion of each of said teeth for communicating through each of said teeth into said flanges to said connecting tube, and support means connected to said tool and extending below said free end portion of each of said teeth for supporting said tool and the vacuum cleaner when said tool is attached to the vacuum cleaner, said support means including an arcuate surface means for permitting said tool to be alternately stroked forwardly and rearwardly with said arcuate surface means in contact with carpeting in a manner which permits said tool to ride smoothly along the carpeting without abruptly snagging the carpeting, whereby weight of the vacuum cleaner is carried by said arcuate surface means rather than being carried by said teeth, said arcuate means including at least one wheel for rolling on the carpeting, said wheel being disposed between adjacent teeth.

5. A carpeting tool as claimed in claim 4, wherein said wheel is rotatably mounted on a pin, said pin being secured to said adjacent teeth.

6. A carpeting tool as claimed in claim 5, wherein a pair of washers are disposed on said pin on each side of said wheel to maintain said wheel in an up-right position.

7. A carpeting tool as claimed in claim 6, wherein said wheel extends approximately one-eighth of an inch below said free end portion of each of said teeth of said tool.

8. A carpeting tool as claimed in claim 4, wherein said arcuate means includes a pair of spaced apart wheels for rolling on the carpeting.

* * * * *